US009128432B2

(12) United States Patent
Kiyama et al.

(10) Patent No.: US 9,128,432 B2
(45) Date of Patent: Sep. 8, 2015

(54) FIXING DEVICE FOR FIXING TONER ON SHEET BY HEATING TONER, AND IMAGE FORMING APPARATUS INCLUDING FIXING DEVICE

(71) Applicant: CANON KABUSHIKI KAISHA, Tokyo (JP)

(72) Inventors: Kota Kiyama, Kawasaki (JP); Isao Hayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/072,115

(22) Filed: Nov. 5, 2013

(65) Prior Publication Data

US 2014/0153980 A1 Jun. 5, 2014

(30) Foreign Application Priority Data

Dec. 3, 2012 (JP) ..... 2012-264735

(51) Int. Cl.
*G03G 15/20* (2006.01)
*G03G 21/16* (2006.01)

(52) U.S. Cl.
CPC ..... *G03G 15/2053* (2013.01); *G03G 21/1652* (2013.01); *G03G 2215/2035* (2013.01)

(58) Field of Classification Search
CPC ..... G03B 15/2053
USPC ..... 399/329
See application file for complete search history.

(56) References Cited

U.S. PATENT DOCUMENTS

| | | | | |
|---|---|---|---|---|
| 6,246,036 | B1 * | 6/2001 | Tsujimoto et al. | 219/619 |
| 2003/0000943 | A1 * | 1/2003 | Yokozeki | 219/619 |
| 2004/0004071 | A1 * | 1/2004 | Ogasawara et al. | 219/619 |
| 2004/0141038 | A1 * | 7/2004 | Takagi et al. | 347/102 |
| 2004/0149735 | A1 * | 8/2004 | Ogasawara et al. | 219/619 |
| 2007/0140758 | A1 * | 6/2007 | Aze et al. | 399/329 |
| 2008/0112720 | A1 * | 5/2008 | Kagawa | 399/69 |
| 2008/0226324 | A1 * | 9/2008 | Baba et al. | 399/69 |
| 2008/0285996 | A1 * | 11/2008 | Kinouchi et al. | 399/69 |
| 2011/0070005 | A1 * | 3/2011 | Mizumo | 399/333 |
| 2012/0057909 | A1 * | 3/2012 | Gon | 399/329 |

FOREIGN PATENT DOCUMENTS

| | | | |
|---|---|---|---|
| JP | 06-202513 | A | 7/1994 |
| JP | 2002-123113 | A | 4/2002 |

* cited by examiner

*Primary Examiner* — Rodney Fuller
(74) *Attorney, Agent, or Firm* — Fitzpatrick, Cella, Harper & Scinto

(57) ABSTRACT

A secondary coil is attached to an end portion of a heating film. A space is formed inside a core member. A primary coil, which generates a magnetic field that causes the secondary coil to generate a current by electromagnetic induction, is arranged inside the space together with the secondary coil.

19 Claims, 10 Drawing Sheets

F I G. 1A
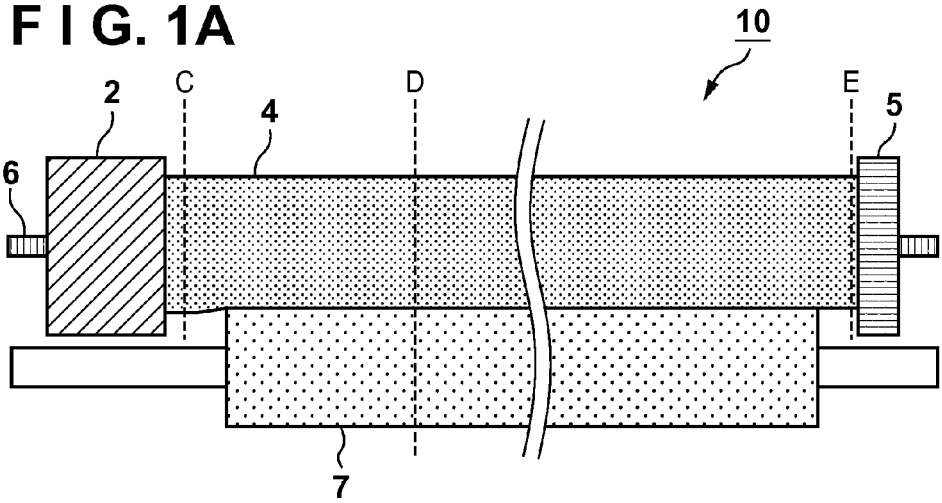
F I G. 1B
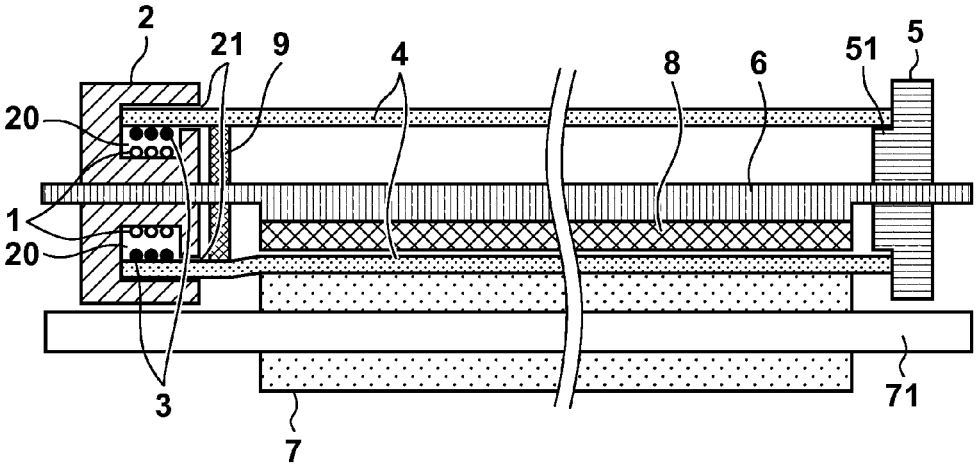
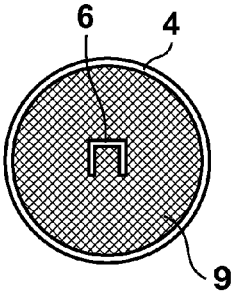
F I G. 1C
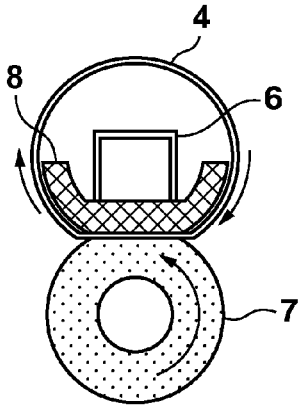
F I G. 1D
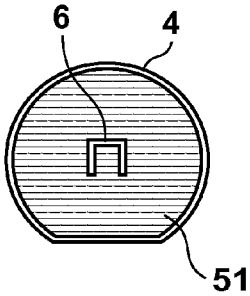
F I G. 1E

FIXING DEVICE FOR FIXING TONER ON SHEET BY HEATING TONER, AND IMAGE FORMING APPARATUS INCLUDING FIXING DEVICE

BACKGROUND OF THE INVENTION

1. Field of the Invention

The present invention relates to a fixing device for fixing toner on a sheet by heating the toner, and an image forming apparatus including the fixing device.

2. Description of the Related Art

An image forming apparatus of an electrophotography scheme or electrostatic recording scheme includes a fixing device used to fix an unfixed toner image formed on a sheet. According to Japanese Patent Laid-Open No. 06-202513, a fixing device, in which a heat generation layer is provided to a fixing film itself, and which supplies a current to this heat generation layer to directly heat the fixing film so as to heat and fix a toner image, has been proposed. This fixing device has merits of a short time period required from the beginning of power supply until a fixable state is reached, and a small power consumption amount. However, since the fixing device of Japanese Patent Laid-Open No. 06-202513 supplies electric power to the heat generation layer using a brush electrode, it readily causes heat generation unevenness in a circumferential direction of the fixing film. This is caused by wearing of the electrode due to sliding contact and an oxide layer formed upon discharging.

In order to solve this problem, according to Japanese Patent Laid-Open No. 2002-123113, a fixing device that supplies electric power to a heating element in a non-contact manner has been proposed. More specifically, by magnetic coupling between primary and secondary coils, each including a core and coil, electric power is supplied from a power source connected to the primary coil to a heating element connected to the secondary coil.

However, in the fixing device of Japanese Patent Laid-Open No. 2002-123113, since a ferrite core included in a fixing roller rotates together with the fixing roller, the rotation load on the fixing roller becomes heavier. Furthermore, when the fixing roller is made of a flexible film-like member, the ferrite core as a load causes deformation, such as torsion, in the film. When such a problem is to be solved by increasing the rigidity of the film, the heat capacity of the film is increased, resulting in a disadvantageous lengthening of the time period from the beginning of power supply until a fixable state is reached, and an increase in power consumption.

SUMMARY OF THE INVENTION

A feature of the present invention is to reduce the rotation load of a rotatable heating element, to reduce deformation of the rotatable heating element, and to realize efficient electric power transmission from a primary coil to a secondary coil.

The present invention may provide a fixing device comprising the following elements. A rotatable heating element is configured to comprise a heat generation layer and a receiving coil required to generate a current to be supplied to the heat generation layer by electromagnetic induction. A transmitting coil is configured to generate a magnetic field required for the receiving coil to generate the current by electromagnetic induction. The transmitting coil is wound around a core member. The receiving coil is mounted to an end portion of the rotatable heating element. The transmitting coil and the receiving coil are arranged in a space formed inside the core member.

Further features of the present invention will become apparent from the following description of exemplary embodiments (with reference to the attached drawings).

BRIEF DESCRIPTION OF THE DRAWINGS

FIGS. 1A to 1E are views for illustrating the basic arrangement of a fixing device;

DESCRIPTION OF THE EMBODIMENTS

Figure 2:
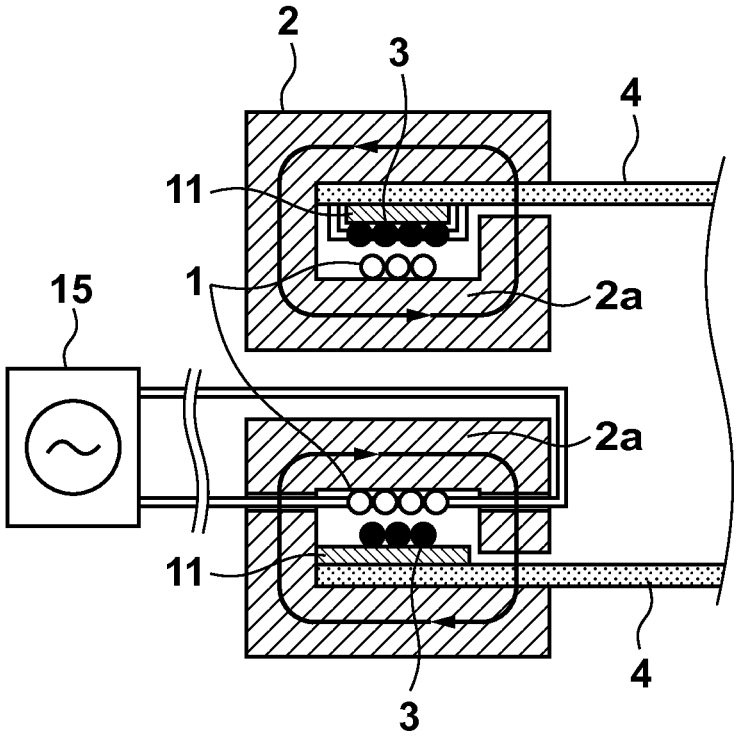
FIG. 2 is a view showing the arrangement of an electric power transmission unit.

Embodiments of the present invention will be described in detail hereinafter with reference to the drawings. Note that members, numeric values, materials, and the like used in the following description are presented only for the purpose of easy understanding, and do not limit the present invention.

FIG. 1A shows the schematic arrangement of a fixing device 10. FIG. 1B is a sectional view in a longitudinal direction of the fixing device 10. FIGS. 1C, 1D, and 1E are sectional views of the fixing device 10 respectively taken along broken lines C, D, and E shown in FIG. 1A. Note that the longitudinal direction of the fixing device 10 is parallel to a rotation axis direction of the fixing device 10. Also, the broken lines C, D, and E are perpendicular to the rotation axis direction of the fixing device 10.

As shown in FIGS. 1A to 1E, the fixing device 10 includes a heating film 4 and a pressure roller 7, and the heating film 4 and pressure roller 7 form a fixing nip portion. The heating film 4 is an example of a rotatable heating element as a cylindrical flexible element. The pressure roller 7 is an example of a pressure element, which is in contact with a part of an outer circumferential surface of the heating film 4 to compress the part of the outer circumferential surface of the heating film 4 so as to form the nip portion between itself and the heating film 4. The pressure roller 7 rotates while being driven by a driving unit such as a motor. The heating film 4 is rotated by receiving a driving force from the pressure roller 7. When a sheet that carries an unfixed toner image passes through this fixing nip portion, the toner image is heated and melted, and is fixed on the sheet.

As shown in FIG. 1A, the heating film 4 is rotatably held by a fixing stay 6, a core member 2, and a fixing flange 5.

As shown in FIG. 1B, the heating film 4 includes a secondary coil 3 in an end portion on one side. The secondary coil 3 is an example of a receiving coil which induces a current to be supplied to a heat generation layer included in the heating film 4 by electromagnetic induction. The secondary coil 3 receives electric power from a primary coil 1 in a non-contact manner. That is, the primary coil 1 functions as a transmitting coil that generates a magnetic field required to cause the secondary coil 3 to induce a current. As shown in FIG. 1B, the outer diameter of the primary coil 1 is smaller than the inner diameter of the secondary coil 3, and the primary coil 1 is arranged on the inner circumference side of the secondary coil 3. Note that the shapes of the primary coil 1 and secondary coil 3 are not particularly limited as long as the secondary coil 3 encloses the primary coil 1.

The core member 2 is a ferrite core, which forms a magnetic flux loop which interlinks the primary coil 1 and secondary coil 3. Note that details of the arrangement of the heating film 4 including the secondary coil 3, and details of the arrangement and operation of an electric power transmission unit including the primary coil 1, the secondary coil 3, and the core member 2 will be described later.

A film guide 8 shown in FIG. 1B is a guide member that is arranged in a cylinder of the heating film 4 so as to be in contact with the inner circumferential surface of the heating film 4 to compress the contact surface of the heating film 4. The film guide 8 is formed of a heat-resistant resin such as a liquid crystal polymer, PPS (polyphenylene sulfide), or PEEK (polyether ether ketone). The film guide 8 is supported by the fixing stay 6. Two end portions in the longitudinal direction of the fixing stay 6 are held by a frame of an image forming apparatus. Since the two end portions in the longitudinal direction of the fixing stay 6 are compressed by a pressure spring (not shown), the film guide 8 is compressed toward the pressure roller 7 side. The fixing stay 6 transmits pressures received on the two end portions in the longitudinal direction to the contact surface of the film guide 8 uniformly in the longitudinal direction. A material of the fixing stay 6 may be, for example, a rigid material such as iron, stainless steel, or zinc-coated steel sheet. Also, as shown in FIG. 1C, the sectional shape in a direction perpendicular to the longitudinal direction of the fixing stay 6 may be a U shape. Thus, the rigidity of the fixing stay 6 is increased, and the contact surface of the fixing stay 6 and that of the film guide 8 are uniformly compressed. Also, the film guide 8 can uniformly transmit a pressure to the heating film 4 in the longitudinal direction of the heating film 4.

The pressure roller 7 includes, for example, a metal core 71 made up of a material such as iron or aluminum, an elastic layer made up of a material such as silicone rubber, and a mold release layer made up of a material such as PFA (perfluoroalkoxyalkane). The hardness of the pressure roller 7 is selected to satisfy a fixing nip width and durability. The hardness ranges, for example, from 40 degrees to 70 degrees at a weight of 1 kgf of an ASKER C hardness scale.

With this arrangement, the fixing nip portion, having a width in the conveyance direction of a sheet as a predetermined width, is uniformly formed in the longitudinal direction of the pressure roller 7. Note that in the film guide 8, a temperature detection element (not shown) is arranged to be in contact with the inner circumferential surface of the heating film 4. The temperature detected by the temperature detection element is used to maintain a target value of a temperature of the heating film 4.

As shown in FIG. 1B, the heating film 4 is held by the fixing flange 5, a film holding member 9, and the core member 2. The heating film 4 is rotated while its inner circumferential surface is in sliding contact with the fixing flange 5 and the film holding member 9. The fixing flange 5 is an example of a first holding member that holds the inner circumferential surface of one end portion of the heating film 4. The film holding member 9 is arranged between the core member 2 and the film guide 8 in the rotation axis direction of the heating film 4, and functions as a second holding member, which holds a part of the inner circumferential surface of the heating film 4. As shown in FIG. 1C, the sectional shape of the film holding member 9, that is, a sectional shape in a direction perpendicular to the rotation axis direction of the heating film 4 is circular. The heating film 4 is rotated upon rotation of the pressure roller 7 while being in sliding contact with the fixing flange 5, the film holding member 9, and the core member 2. The fixing flange 5 and film holding member 9 are attached to the fixing stay 6.

As shown in FIG. 1D, the heating film 4 has flexibility. Therefore, since a region of the heating film 4, which contacts the film guide 8, is rotated while being in sliding contact with the film guide 8, it is deformed to follow the shape of the sliding contact surface of the film guide 8. As shown in FIG. 1E, a sectional shape of a convex portion 51, which holds the heating film 4, of the fixing flange 5, is the same as the shape of the heating film 4 upon rotation shown in FIG. 1D. A circumferential surface from a region corresponding to the film guide 8 until a region held by the fixing flange 5 of that of the heating film 4 is rotated while maintaining the shape shown in FIGS. 1D and 1E.

On the other hand, the film holding member 9 has the circular sectional shape, as shown in FIG. 1C. For this reason, in a region on the left side of the film holding member 9 in FIG. 1B, the shape upon rotation of the heating film 4 is circular. The core member 2 has a ring-shaped communicating portion 21. A space 20 of a cylindrical shape (ring shape) is formed inside the core member 2. The space 20 communicates with the exterior of the core member 2 via the communicating portion 21 as a part of the space 20. Via this communicating portion 21, the end portion of the heating film 4 is inserted into the core member 2. The end portion inserted in the core member 2 of those of the heating film 4 includes the secondary coil 3. The primary coil 1 is wound along the inner circumferential surface of the outer circumferential surface (outer diameter surface) and inner circumferential surface (inner diameter surface) which define the space 20 of the cylindrical shape. The circumferential surface (a sliding contact surface of a central portion of the core member 2) of the ring-shaped communicating portion 21 holds the inner circumferential surface (inner diameter surface) of the other end portion of the heating film 4. A sectional shape of the communicating portion 21, that is, a sectional shape in a direction perpendicular to the rotation axis direction of the heating film 4 is circular. In this manner, since the sectional shape of the film holding member 9 and that of the communicating portion 21 are circular, the secondary coil 3 included in the left end portion of the heating film 4 can be rotated while maintaining a circular shape. In this manner, the shape upon rotation of the heating film 4 is different, depending on a position in the longitudinal direction. This difference is absorbed by the flexibility of the heating film 4 in the region between the film holding member 9 and film guide 8.

Since the film holding member 9 is arranged, the communicating portion 21 of the core member 2 need not have a circular shape. However, when the core member 2 also functions as the film holding member 9 without using the film holding member 9, the communicating portion 21 has to have a circular sectional shape. In either case, the circular sectional shape of the secondary coil 3 need only be maintained.

The electric power transmission unit will be described below with reference to FIG. 2. The electric power transmission unit includes the primary coil 1 connected to an AC power source circuit 15, the secondary coil 3 mounted to the heating film 4, and the core member 2 which forms a magnetic flux loop that interlinks the primary coil 1 and the secondary coil 3. As a wire material of the primary coil 1 and secondary coil 3, for example, a litz wire, which can accommodate the flow of an AC current of about 10 A with a low loss, can be used. The number of turns of the primary coil 1 and the secondary coil 3 is determined in consideration of the arrangement of a magnetic circuit, the coil radius, the AC frequency, and the like, and is, for example, about several to 10 turns.

As shown in FIG. 2, the primary coil 1 and the secondary coil 3 are arranged so that each other's positions overlap each other in a central axis direction (a lateral direction of FIG. 2) of the primary coil 1. That is, a winding center of the primary coil 1 matches that of the secondary coil 3. Also, the primary coil 1 and secondary coil 3 are formed in a nearly concentric shape.

The primary coil 1 is wound around a cylindrical central portion 2*a* of the core member 2. The secondary coil 3 is adhered to the inner surface of a cylindrical secondary coil holding member 11. The secondary coil holding member 11 is adhered to the inner circumferential surface of the heating film 4. In this manner, the secondary coil 3 is arranged in the end portion of the heating film 4. A fixing method of the secondary coil 3 may be methods other than an adhesion method. As the secondary coil holding member 11, for example, a lightweight heat-resistant resin or the like, is used. This is done to maintain the circular sectional shape of the secondary coil 3. Note that the secondary coil 3 may be directly attached to the inner circumferential surface of the heating film 4 without using the secondary coil holding member 11. In this case, a member that maintains the circular sectional shape of the heating film 4 may be equipped in the end portion of the heating film 4.

Figure 3A:
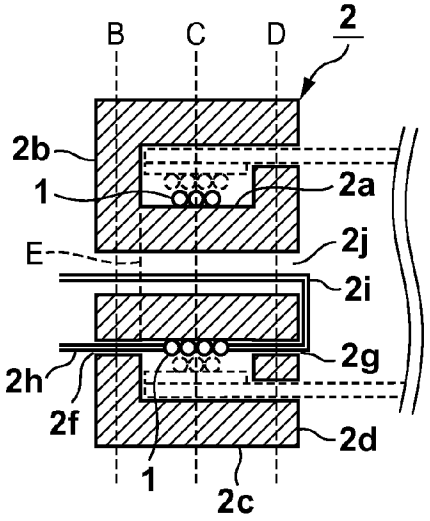
FIGS. 3A to 3D are views for illustrating a core member shape.
Figure 3B:
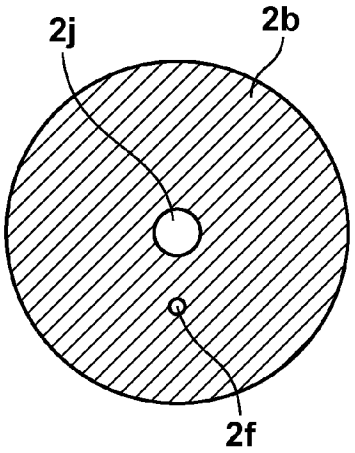
Figure 3C:
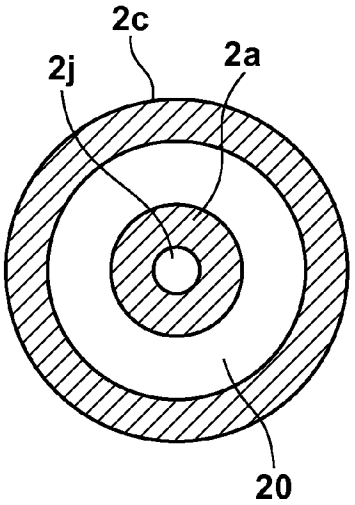
Figure 3D:
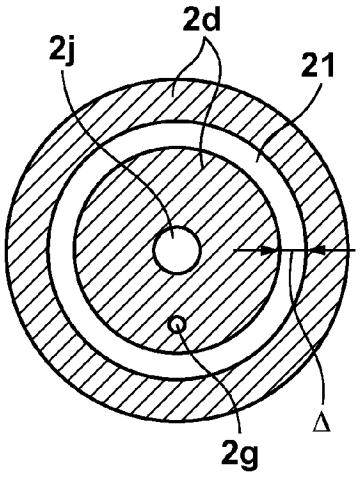

The shape of the core member 2 will be described below with reference to FIGS. 3A to 3D. FIG. 3A is a sectional view including the central axis of the core member 2. FIGS. 3B, 3C, and 3D are sectional views of the core member 2 respectively taken along broken lines B, C, and D shown in FIG. 3A.

The overall shape of the core member 2 is a columnar shape. The core member 2 has a circular first end face (left side surface 2*b*), a circular second end face (right side surface 2*d*), and cylindrical outer circumferential surface 2*c*. The cylindrical space 20 is formed inside the core member 2. The shape of the core member 2 is designed to roughly surround the primary coil 1 wound around the central portion 2*a*. The communicating portion 21 as a gap portion is formed between the outer circumferential surface 2*c* and right side surface 2*d*. The end portion including the secondary coil 3 of the two end portions of the heating film 4 is inserted into the space 20 formed inside the core member 2 via the communicating portion 21. In this manner, the primary coil 1 and the secondary coil 3 are arranged so that their concentric positions in the axial direction overlap each other in the space 20 inside the core member 2.

As shown in FIG. 3D, the communicating portion 21 has a circular sectional shape. When a width Δ (the difference between the outer and inner diameters of the communicating portion 21) in the radial direction of the communicating portion 21 becomes larger, a leaking magnetic flux increases. That is, since electric power transmission efficiency decreases, the width Δ is selected to be small as much as possible. In this embodiment, the width Δ of the communicating portion is larger than the thickness of the heating film 4 located inside the space 20, and is smaller than a combined thickness of the secondary coil 3, secondary coil holding member 11, and heating film 4 at a position where the secondary coil 3 is arranged.

The core member 2 may be integrally formed. In this case, it is difficult to assemble the fixing device 10. Thus, the core member 2 of this embodiment is configured by two members divided by a broken line E (the boundary between the central portion 2*a* and left side surface 2*b*) shown in FIG. 3A.

Figure 4A:
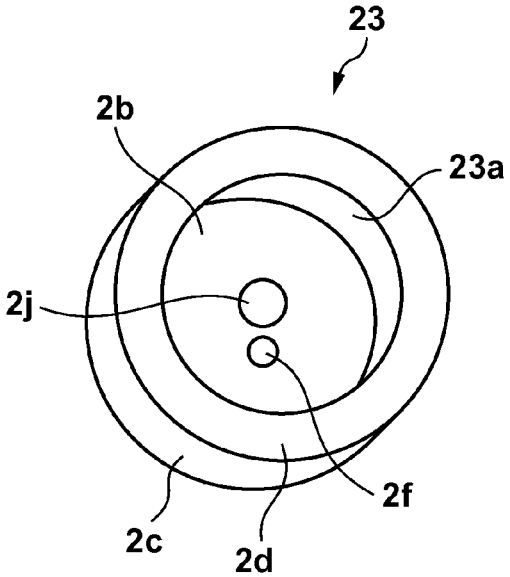
FIGS. 4A and 4B are views for illustrating a core member shape.
Figure 4B:
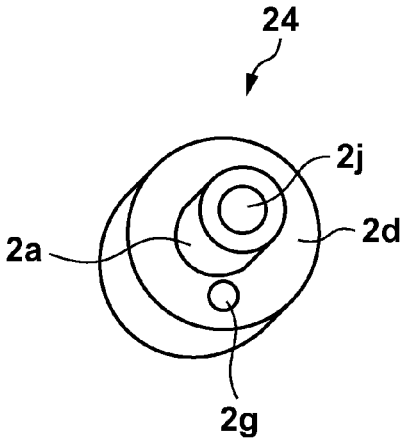

As shown in FIGS. 4A and 4B, the core member 2 is completed by coupling a bowl-shaped outer member 23, which is obtained by hollowing out a portion of a column in an axial direction, and an inner member 24 having a convex sectional shape. The inner member 24 is attached while being inserted to the inner circumferential surface side of the outer member 23, so as to form the space 20 between itself and the inner circumferential surface 23*a* of the outer member 23, and the primary coil 1 is wound around the inner member 24. The bowl-shaped outer member 23 is defined by the outer circumferential surface 2*c*, the left side surface 2*b*, and a part of the right side surface 2*d*. Also, the inner member is defined by the central portion 2*a* and the remaining part of the right side surface 2*d*.

As shown in FIGS. 3B and 3D and FIGS. 4A and 4B, a first through hole 2*f*, which communicates with the space 20, is formed in the left side surface 2*b*. A cable 2*h*, as a wire from the AC power source circuit 15, is connected to one end of the primary coil 1 via the first through hole 2*f*. A second through hole 2*g*, which communicates with the space 20, is formed in the right side surface 2*d* of the core member 2. A cable 2*i* as a wire from the AC power source circuit 15 is connected to the other end of the primary coil 1 via the second through hole 2*g*. The cable 2*i* is temporarily pulled out to a right external portion of the core member 2 via the second through hole 2*g* formed in the right side surface 2*d*, and is further pulled out to a left external portion of the core member 2 via a central through hole 2*j* formed at the center of the core member 2. Note that the wire pull-out method from the primary coil 1 may adopt other methods. For example, both the wires connected to the two ends of the primary coil 1 may be pulled out together from the first through hole 2*f* formed in the left side surface 2*b*. In this case, a process for forming the second through hole 2*g* can be omitted.

Figure 5A:
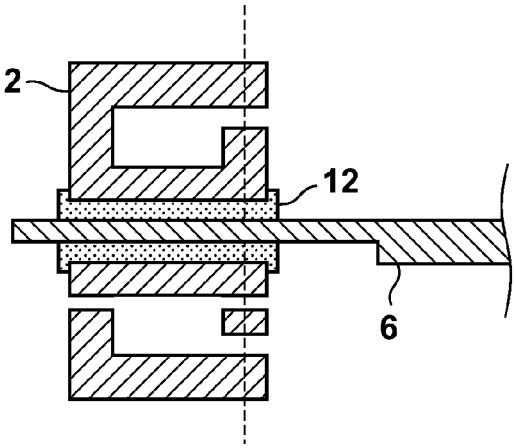
FIGS. 5A and 5B are views for illustrating a core member setting method.
Figure 5B:
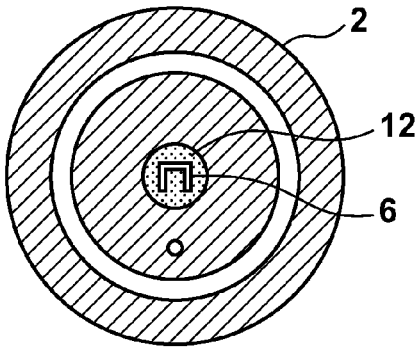

FIG. 5A is a sectional view including the central axis of the core member 2. FIG. 5B is a sectional view taken along a broken line shown in FIG. 5A. As shown in FIGS. 5A and 5B, the core member 2 is fixed to the fixing stay 6 via a core holding member 12.

Figure 6A:
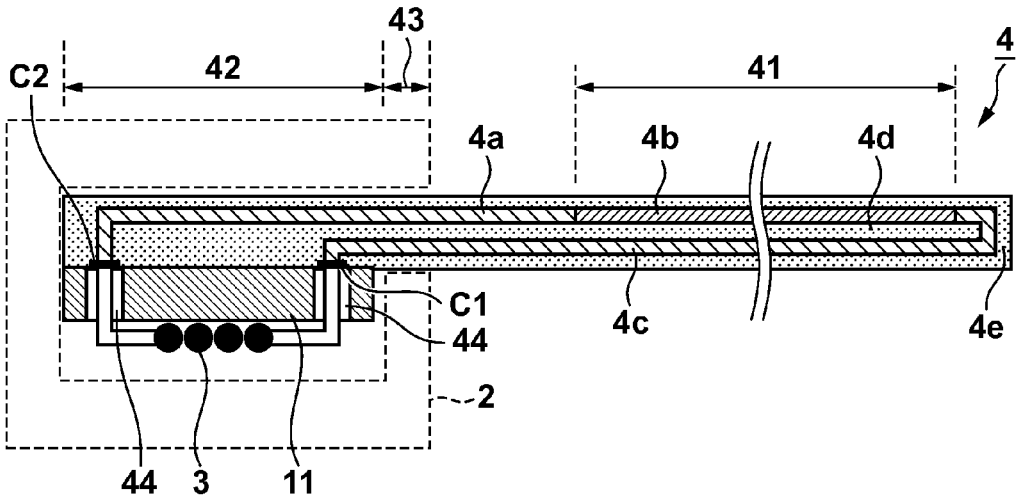
FIGS. 6A and 6B are views showing the layer arrangement of a heating film.
Figure 6B:
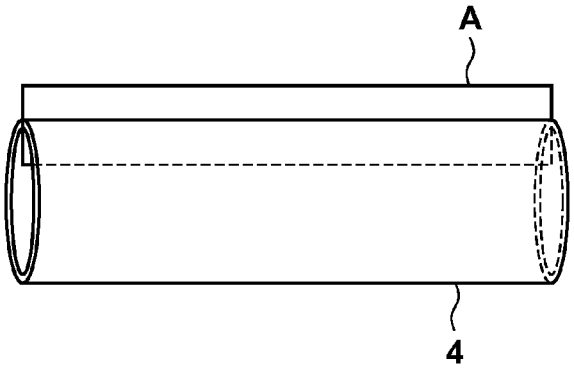

The arrangement of the heating film 4 including the secondary coil 3 will be described below with reference to FIGS. 6A, 6B, 7A, 7B, and 7C. FIG. 6A illustrates a section taken along a plane A of the heating film 4 shown in FIG. 6B. As shown in FIG. 6A, the heating film 4 has a fixing region 41, core internal region 42, and core gap portion passing region 43. In the fixing region 41, the fixing nip portion is formed between the pressure roller 7 and the heating film 4 to fix a toner image. The fixing region 41 adopts a multi-layered structure. That is, an insulating layer 4*d* is formed between a heat generation layer 4*b* and the conductive layer 4*c*. An insulating layer 4*e* is also formed on the outer side of the heat generation layer 4*b* and the inner side of the conductive layer 4*c*.

The heat generation layer 4*b* is formed of polyimide, the resistance value of which is adjusted by dispersing carbon black as a conductive filler, and the actual resistance value across the two end portions in the longitudinal direction is about several to ten-odd Ω. The insulating layers 4*d* and 4*e* are formed of polyimide. The conductive layers 4*a* and 4*c* are formed of, for example, a metal material, such as copper or aluminum. Although not shown in FIG. 6A, an elastic layer and a mold release layer may further be formed on the outer surface of the heating film 4. As the elastic layer in this case, silicone rubber or the like may be adopted, and as the mold release layer, PFA or the like may be adopted.

As shown in FIG. 6A, one end of the conductive layer 4*c* is connected to one end of the heat generation layer 4*b*, and the other end is connected to one end of the secondary coil 3. One end of the conductive layer 4*a* is connected to the other end of the secondary coil 3, and the other end of the conductive layer 4*a* is connected to the other end of the heat generation layer 4*b*. The conductive layer 4*c* is also formed up to the core internal region 42, is exposed to an inner surface of the heating film 4, and has a contact C1 used to be connected to the secondary coil 3. Likewise, the conductive layer 4*a* is also formed up to the core internal region 42, is exposed to the inner surface of the heating film 4, and has a contact C2 used to be connected to the secondary coil 3.

Figure 7A:
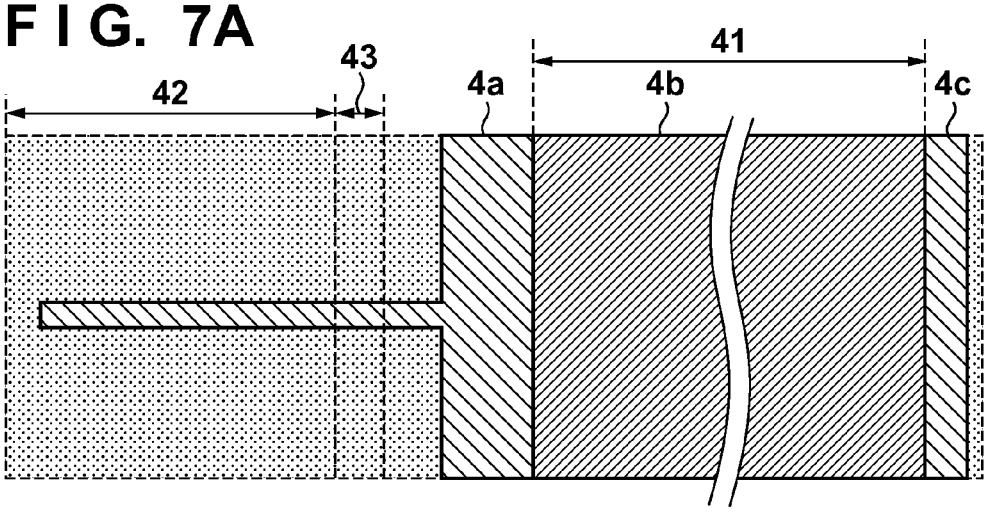
FIGS. 7A to 7C are views for illustrating shapes of respective layers of the heating film.
Figure 7B:
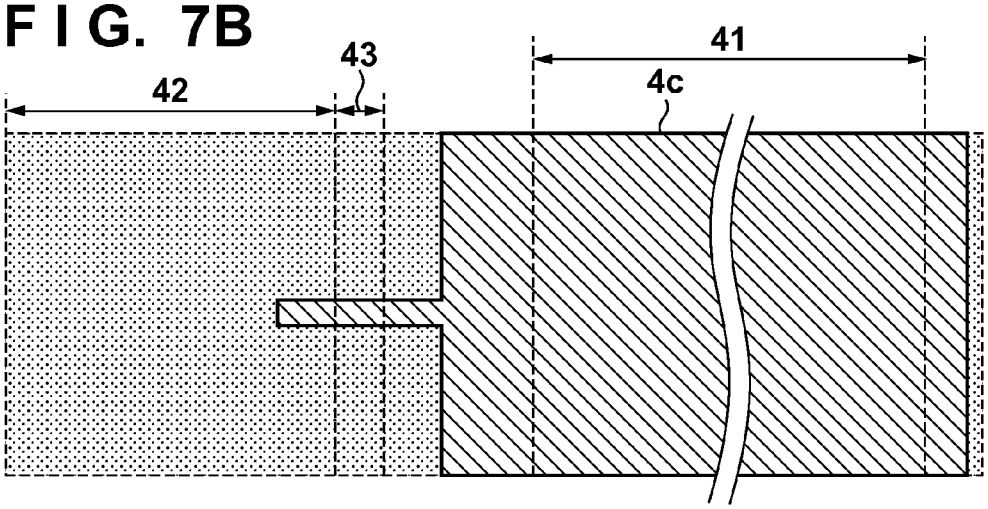
Figure 7C:
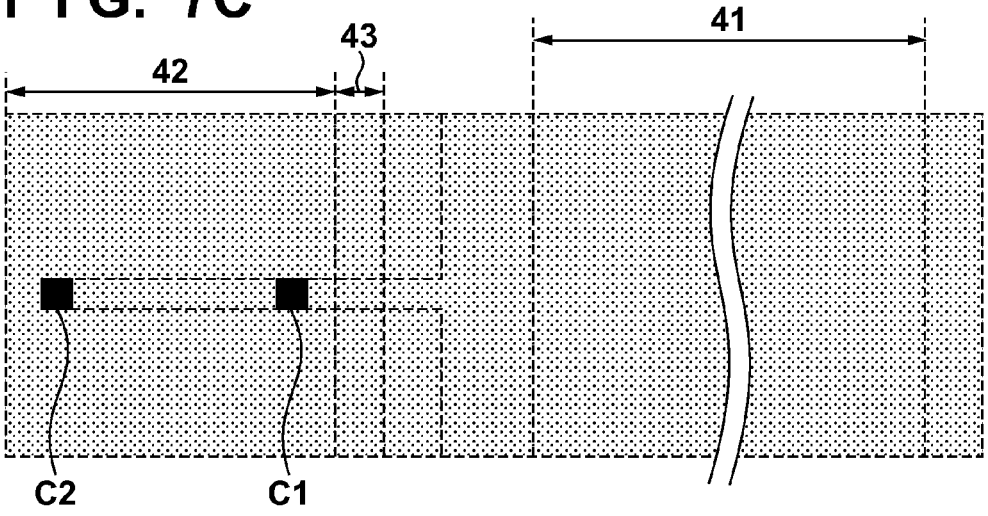

FIGS. 7A, 7B, and 7C are views for illustrating shapes of respective layers, and show the cylindrical heating film 4, which is shown as a rectangle for the sake of descriptive convenience. Especially, FIG. 7A shows a layer including the heat generation layer 4*b*. FIG. 7B shows a layer including the conductive layer 4*c*. FIG. 7C shows the inner circumferential surface of the heating film 4.

As shown in FIG. 7A, the heat generation layer 4*b* is formed on the fixing region 41. In this manner, the heat generation layer 4*b* is formed on a portion of the heating film 4, which is not inserted into the core member 2. This is to assure a necessary and sufficient area to heat the fixing nip portion. On the other hand, the conductive layer 4*a* is formed over the entire circumference in the circumferential direction of the heating film 4 in the vicinity of the heat generation layer 4*b*, but it is formed only on a portion in the circumferential direction around the core gap portion passing region 43 and the core internal region 42.

As shown in FIG. 7B, the conductive layer 4*c* is formed over the entire circumference in the circumferential direction of the heating film 4 on and around the fixing region 41, but it is formed only on a portion in the circumferential direction around the core gap portion passing region 43 and the core internal region 42.

Of conductive members such as the conductive layers 4*a* and 4*c*, an area of a region inserted into the core member 2 is smaller than that of a region which is not inserted into the core member 2 of the conductive members. The reason why the conductive layers 4*a* and 4*c* are formed in such shapes is that the electric power transmission efficiency drop caused by shielding a magnetic flux, which passes through the core gap portion passing region 43, by the conductive layers 4*a* and 4*c* is suppressed as much as possible.

As shown in FIG. 7C, the contact C1 used to connect the secondary coil 3 and the conductive layer 4*a*, and the contact C2 used to connect the secondary coil 3 and the conductive layer 4*c* are formed on the inner circumferential surface of the heating film 4. In this manner, the two ends of the secondary coil 3 are respectively connected to the contacts C1 and C2. Note that in the secondary coil holding member 11, notches 44 are formed in portions that overlap the contacts C1 and C2. In this way, the secondary coil 3 can be connected to the contacts C1 and C2.

As described above, the conductive layer 4*a*, the heat generation layer 4*b*, and the conductive layer 4*c* of the heating film 4, and the secondary coil 3 form a closed circuit. When electric power is transmitted from the primary coil 1 to the secondary coil 3, a current flows to the heat generation layer 4*b* via the conductive layers 4*a* and 4*c*, thus heating the heat generation layer 4*b*. The arrangement of the heating film 4 has been explained, and the description will revert to that of the operation of the electric power transmission unit.

Figure 8:
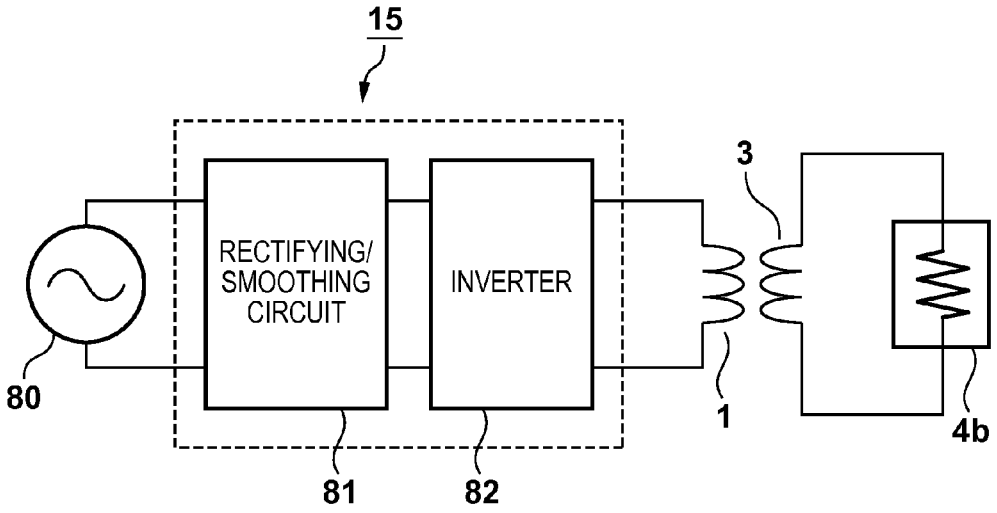
FIG. 8 is a schematic circuit diagram showing the circuit arrangement of an electric power transmission system.

The AC power source circuit 15 shown in FIG. 2 includes a rectifying/smoothing circuit 81 and an inverter 82, as shown in FIG. 8. The rectifying/smoothing circuit 81 rectifies and smooths an AC voltage input from a commercial power source 80, and outputs the voltage to the inverter 82. The inverter 82 converts this voltage into, for example, an AC voltage of 100 V and 200 kHz, and outputs the converted voltage. Since an AC current of 200 kHz flows through the primary coil 1 connected to the AC power source circuit 15, a magnetic flux loop is formed inside the core member 2.

For example, when a current flows through the primary coil 1 clockwise viewed from the left side of FIG. 2, a magnetic flux loop indicated by an arrow of FIG. 2 is formed. When a current flows in an opposite direction, a magnetic flux loop in a direction opposite to the arrow of FIG. 2 is formed. Since the AC current of 200 kHz flows through the primary coil 1, the magnetic flux loop inside the core member 2 also changes at 200 kHz. By an electromagnetic induction effect caused by this change in magnetic flux loop, a current flows through the secondary coil 3. In this manner, electric power is transmitted from the primary coil 1 to the secondary coil 3 in a non-contact manner.

As described above, according to the first embodiment, the secondary coil 3 is arranged in the end portion of the heating film 4, and the primary coil 1 and the secondary coil 3 are arranged in the space 20 formed inside the core member 2. Since the core member 2 is designed to roughly surround the primary coil 1 and the secondary coil 3, induction of a leaking magnetic flux can be suppressed to be low. Therefore, electric power can be efficiently transmitted from the primary coil 1 to the secondary coil 3. The core member 2 is fixedly arranged in the fixing device 10, and the rotating heating film 4 does not include the core member 2. For this reason, the rotation load on the heating film 4 can be reduced. That is, since the core member 2 does not impose any load on the heating film 4, the heating film 4 is nearly free from any deformation such as torsion.

The outer diameter of the primary coil 1 is smaller than the inner diameter of the secondary coil 3, and the primary coil 1 is arranged on the inner circumference side of the secondary coil 3. The space 20 of the core member 2 has a cylindrical shape, and a portion of the space 20 communicates with the exterior of the core member 2 via the communicating portion 21. The end portion of the heating film 4 is inserted into the core member 2 via this communicating portion 21. The primary coil 1 is wound around the inner circumferential surface of the outer and inner circumferential surfaces, which define the space 20. Thus, the primary coil 1 and the secondary coil 3 can be confined in the inner space of the core member 2.

The heat generation layer 4*b* of the heating film 4 is formed on a portion, which is not inserted into the core member 2, of the heating film 4. That is, since the heat generation layer 4*b* is formed on the fixing region 41 of the heating film 4, it can efficiently heat the fixing region 41. Also, since the heat generation layer 4*b* has a small area, power consumption can be reduced.

As shown in FIGS. 7A and 7B, an area of a region inserted into the core member 2 of the conductive layers 4*a* and 4*c* is smaller than that of a region which is not inserted into the core member 2 of the conductive layers 4*a* and 4*c*. Thus, a magnetic flux of the core member 2 is hardly disturbed, and electric power can be efficiently transmitted.

As shown in FIG. 1A and the like, the entire shape of the core member 2 is a columnar shape, and the ring-shaped communicating portion 21 is formed in the right side surface 2*d* of the core member 2. Furthermore, the first through hole 2*f*, which communicates with the space 20, is formed in the left side surface 2*b*, and the wire from the power source is connected to one end of the primary coil 1 via the first through hole 2*f*. Note that the wire from the power source, which is to be connected to the other end of the primary coil 1, can be arranged in the first through hole 2*f* or second through hole 2*g*. That is, when the two wires are connected via the first through hole 2*f*, the second through hole 2*g* can be omitted. On the other hand, when the second through hole 2*g* is formed, the two wires can be prevented from being short-circuited.

The pressure roller 7 contacts a portion of the outer circumferential surface of the heating film 4 as a flexible element to compress the portion of the outer circumferential surface of the heating film 4, and forms the nip portion between itself and the heating film 4. The film guide 8 contacts a portion of the inner circumferential surface of the heating film to restrict the shape upon rotation of the outer circumferential surface of the heating film 4. Note that the shape of a portion other than the nip portion of the outer circumferential surface of the heating film in the direction perpendicular to the rotation axis of the heating film 4 is nearly circular. On the other hand, the portion of the nip portion of the heating film 4 is flattened since it is restricted by the film guide 8. That is the fixing nip portion can be formed at the flattened portion of the heating film 4.

The fixing flange 5 holds the inner circumferential surface of one end portion of the heating film 4. The circumferential surface (sliding contact surface) of the ring-shaped communicating portion 21 holds the inner circumferential surface of the other end portion of the heating film 4. The sectional shape of the communicating portion 21 in the direction perpendicular to the rotation axis direction of the heating film 4 is circular. Thus, the circular sectional shape of the secondary coil 3 arranged in the end portion of the heating film 4 can be maintained.

Note that the sectional shape of the heating film 4 is locally circular, and is quasi-circular (hog-backed or D shape) near the fixing region 41. This sectional shape difference readily causes torsion in the heating film 4. Thus, the film holding member 9 may be arranged between the ring-shaped communicating portion 21 and the film guide 8 in the rotation axis direction of the heating film 4. The film holding member 9 slidably holds a portion of the inner circumferential surface of the heating film 4. Since the film holding member 9 has a circular sectional shape, it can moderately shift the shape of the heating film 4 from quasi-circular to circular. However, when the heating film 4 is sufficiently flexible, and the frictional force between the core member 2 and the heating film 4 is small, the film holding member 9 may be omitted.

As shown in FIGS. 1B, 2, and 3D, the width Δ of the communicating portion 21 is smaller than that of the end portion of the heating film 4 including the secondary coil 3. In this manner, by reducing the width Δ of the communicating portion 21, leakage of a magnetic flux can be easily prevented.

Since the winding center of the primary coil 1 matches that of the secondary coil, and the primary coil 1 and the secondary coil 3 are nearly concentrically formed, the transmission efficiency of electric power by means of electromagnetic induction is excellent.

As shown in FIGS. 4A and 4B, since the core member 2 is formed while being divided into the bowl-shaped outer member 23 and the inner member 24 around which the primary coil 1 is wound, the core member 2 can be easily manufactured, and the primary coil 1 and the secondary coil 3 can be easily arranged in the space 20. That is, the fixing device 10 can be easily assembled.

In a fixing device of Japanese Patent Laid-Open No. 2002-123113, a primary ferrite core and a secondary ferrite core form a magnetic flux loop which interlinks with a coil. For this reason, when the secondary ferrite core is removed, the number of magnetic fluxes which interlink with the secondary coil is decreased, and electric power transmission efficiency from the primary coil to the secondary coil decreases. In this manner, in the invention of Japanese Patent Laid-Open No. 2002-123113, when the secondary ferrite core is simply removed, electric power transmission efficiency unwantedly decreases. On the other hand, in the present invention, the primary coil 1 and the secondary coil 3 are surrounded by the core member 2, and are confined in the inner space 20. Hence, compared to the invention of Japanese Patent Laid-Open No. 2002-123113, the present invention is advantageous in terms of electric power transmission efficiency.

The description of the first embodiment explained the example in which the communicating portion 21 of the core member 2 has a circular sectional shape. However, since the sectional shape near the fixing region 41 of the heating film 4 is a quasi-circular shape including a linear portion in the circumference, it does not match the shape of the communicating portion 21 of the core member 2. For this reason, the film holding member 9 is required. Also, the shape shift interval has to be assured from the fixing region 41 to the core member 2. Hence, the description of the second embodiment will explain a case in which the sectional shape of the communicating portion 21 correlates or matches that near the fixing region 41 of the heating film 4.

Figure 9A:
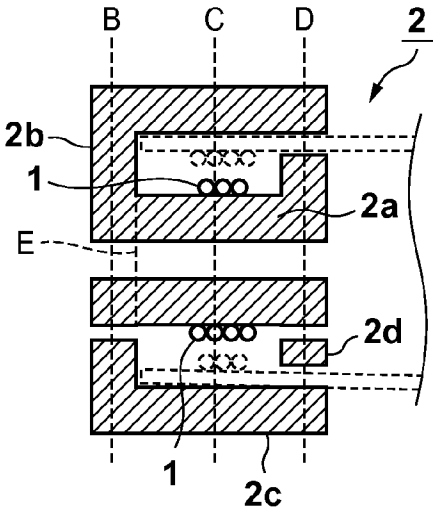
FIGS. 9A to 9D are views for illustrating a core member shape.
Figure 9B:
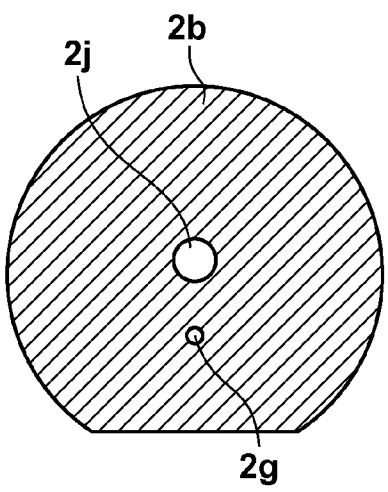
Figure 9C:
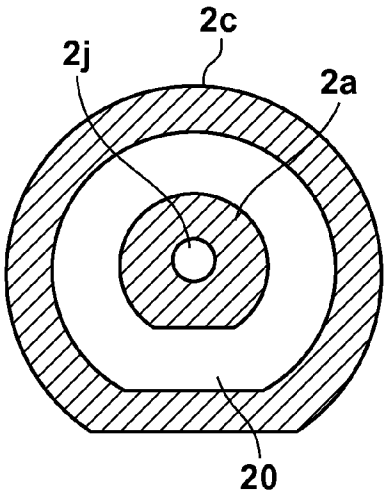
Figure 9D:
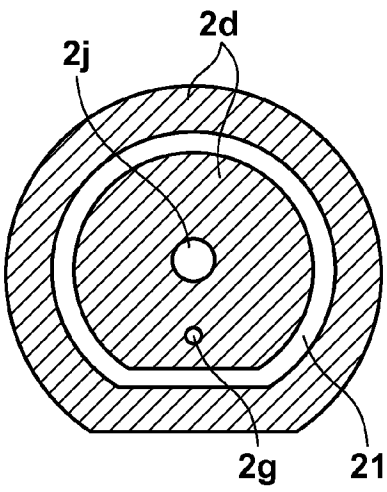

The shape of a core member 2 of the second embodiment will be described below with reference to FIGS. 9A, 9B, 9C, and 9D. FIG. 9A is a sectional view taken along a central axis direction (a direction parallel to a longitudinal direction of a heating film 4) of the core member 2. FIGS. 9B, 9C, and 9D are sectional views respectively taken along broken lines B, C, and D shown in FIG. 9A.

As shown in FIGS. 9B, 9C, and 9D, a sectional shape of each of a central portion 2*a*, a left side surface 2*b*, an outer circumferential surface 2*c*, and a right side surface 2*d* of the core member 2 is circular in a portion and is flattened in the remaining portion. That is, each of these sectional shapes is quasi-circular (hog-backed or D shape). As described above, in order to form a fixing nip portion, the shape of a circumferential surface of a portion of the heating film 4 is flattened by shapes of a film guide 8 and the fixing flange 5 during rotation. Thus, a sectional shape of a communicating portion 21 of the core member 2 is matched with that near a fixing region 41 of the heating film 4. This is because the film guide 8 is arranged so that an outer edge of the sectional shape of the ring-shaped communicating portion 21 matches the sectional shape of the heating film 4 in the direction perpendicular to the rotation axis of the heating film. Thus, the heating film 4 has the same sectional shape over the entire range in the longitudinal direction. That is, the shape shift interval can be omitted.

In the second embodiment, the communicating portion 21 is formed between the outer circumferential surface 2*c* and the right side surface 2*d*, as in the first embodiment. As shown in FIG. 9D, the shape of this communicating portion 21 is the same as the sectional shape of the heating film 4 in the fixing region 41. A primary coil 1 is wound around the central portion 2*a* of the core member 2 to follow its sectional shape.

Since the arrangement of the core member 2 and the heating film 4, a width of a gap portion of the core member 2, a pull-out method of wires to the primary coil, a setting method of the core member 2, and the like of the second embodiment are the same as those in the first embodiment, a description thereof will not be repeated.

Figure 10A:
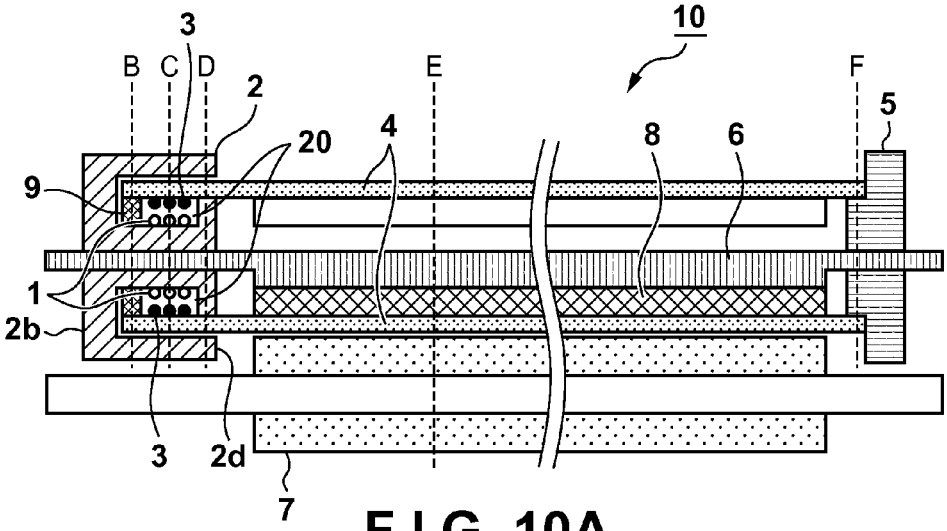
FIGS. 10A to 10F are views for illustrating explaining the basic arrangement of a fixing device.

The arrangement of a fixing device 10 including the core member 2 of the second embodiment will be described below with reference to FIGS. 10A to 10F. FIG. 10A is a sectional view in the longitudinal direction of the fixing device 10. FIGS. 10B to 10F are sectional views of the fixing device 10 respectively taken along broken lines B, C, D, E, and F shown in FIG. 10A. Note that the same reference numerals denote parts which have already been explained for the sake of simplicity.

As shown in FIG. 10A, the heating film 4 is held by the fixing flange 5 and a film holding member 9, and is rotated upon rotation of a pressure roller 7 while being in sliding contact with the fixing flange 5 and the film holding member 9. According to the second embodiment, the film holding member 9 is arranged in an inner space 20 of the core member 2. The film holding member 9 is arranged at a position closer to the left side surface 2*b* than the right side surface 2*d*, and is attached to the core member 2.

Figure 10B:
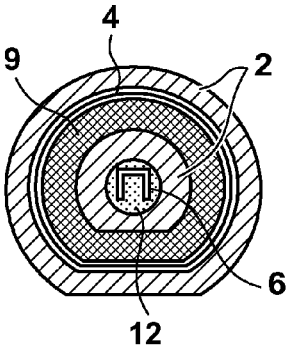
Figure 10C:
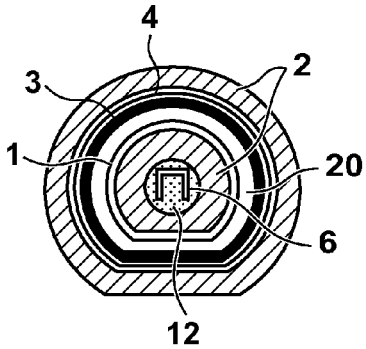
Figure 10D:
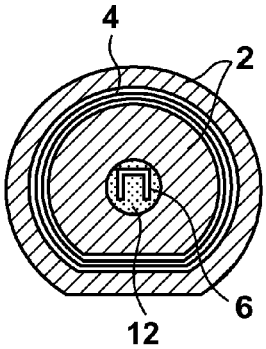
Figure 10E:
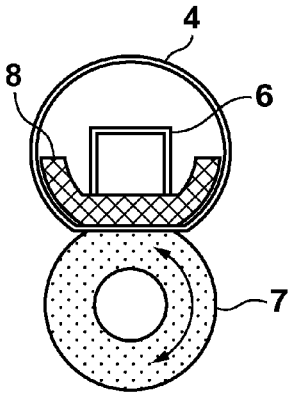
Figure 10F:
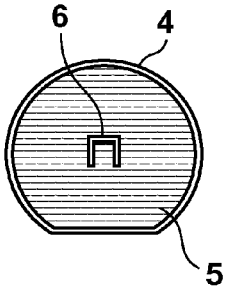

The sectional shape of a convex portion, which holds the heating film 4, of the fixing flange 5, that of the film holding member 9, and that of the communicating portion 21 of the core member 2 are nearly the same shape, as shown in FIGS. 10F, 10B, and 10C. Therefore, the heating film 4 of the second embodiment is rotated to draw the same sectional shape over the entire range of in the longitudinal direction, as shown in FIGS. 10B to 10F.

The heating film 4 includes a secondary coil 3. As shown in FIG. 10C, the secondary coil 3 also has to be rotated together with the heating film 4 while maintaining its sectional shape. Hence, the secondary coil 3 is formed using a flexible wire.

Figure 11:
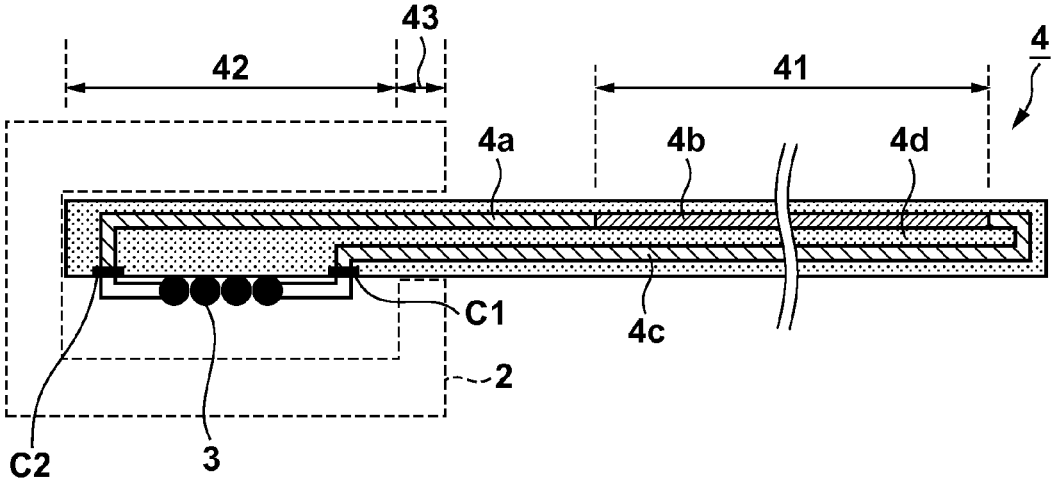
FIG. 11 is a view for illustrating the layer arrangement of a heating film.

As shown in FIG. 11, the secondary coil 3 is directly attached to the heating film 4. That is, the secondary coil holding member 11 used in the first embodiment is omitted in the second embodiment. Since the shape of the secondary coil 3 is maintained by the film holding member 9, the secondary coil holding member 11 can be omitted. The arrangement of the heating film 4 itself shown in FIG. 11 and an electrical connection between the secondary coil 3 and the heating film 4 are the same as those in the first embodiment.

As described above, according to the second embodiment, the sectional shape of a portion of the ring-shaped communicating portion 21 is circular, and that of the remaining portion is flattened. Thus, the heating film 4 is rotated in the same sectional shape over the entire range in the longitudinal direction. Therefore, in the second embodiment, in addition to the same effects as in the first embodiment, a stress caused by a sectional shape difference hardly acts on the heating film 4. This is advantageous in terms of the durability of the heating film 4. Also, the sectional shape difference between the left end portion and the remaining portion of the heating film need not be absorbed by the flexibility of the heating film 4. Hence, since the need for a shift interval required to absorb the sectional shape difference in the heating film 4 can be obviated, the size in the longitudinal direction of the heating film 4 can be reduced.

Figure 12:
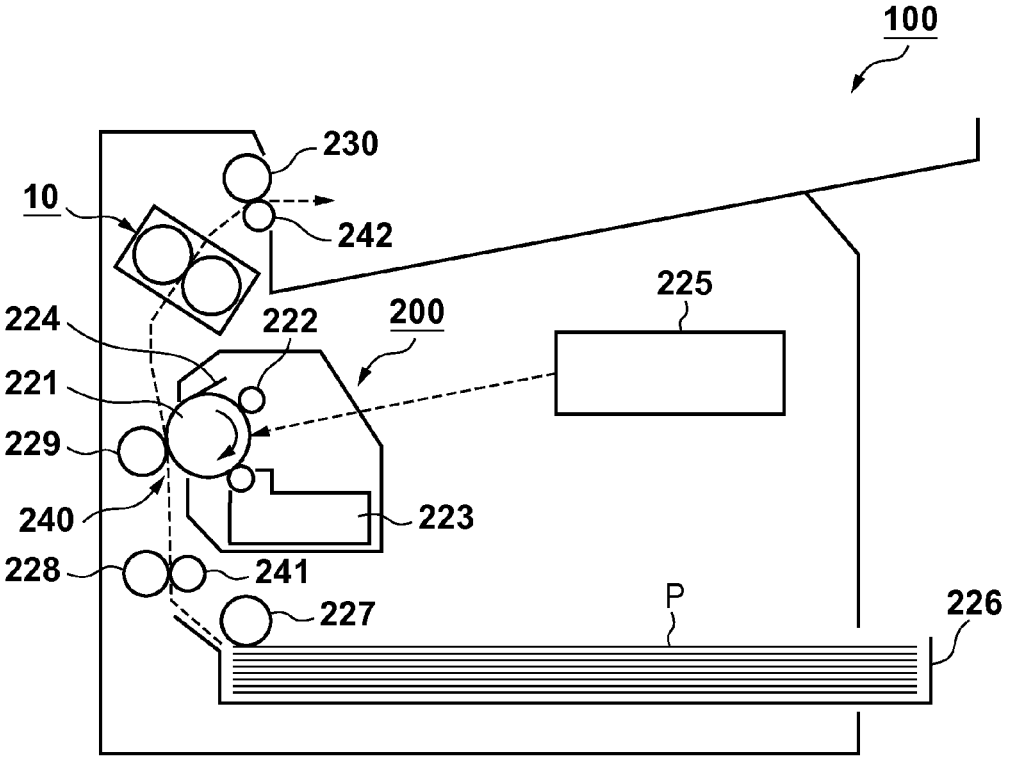
FIG. 12 is a view for illustrating the basic arrangement of an image forming apparatus.

A basic arrangement and operation of an image forming apparatus 100, which can use the fixing device 10 described in the first and second embodiments as a fixing unit, will be described below with reference to FIG. 12. As shown in FIG. 12, the image forming apparatus 100 is a monochrome image forming apparatus including one image forming unit 200. Note that the image forming apparatus 100 may be a color image forming apparatus.

In the image forming unit 200, charging, exposure, and development processes are executed while rotating a photosensitive drum 221, thus forming a toner image on the surface of the photosensitive drum 221. A charging roller 222 uniformly charges the surface of the photosensitive drum 221. Next, a laser scanner 225 scans a laser beam, which is ON-OFF modulated according to image data, by a rotary mirror, and forms an electrostatic latent image corresponding to the image data on the surface of the photosensitive drum 221. A developer 223 develops the electrostatic latent image as a toner image using toner charged to have a polarity opposite to that of the electrostatic latent image. A cleaning blade 224 is in sliding contact with the photosensitive drum 221, and removes transfer residual toner which remains on the surface of the photosensitive drum 221 after passing through a transfer unit 240.

Sheets P in a sheet cassette 226 are picked up one by one by a pickup roller 227. The sheet P is conveyed while being clamped by a registration roller 228 and a counter roller 241 in synchronism with a toner image formation timing in the image forming unit 200. Furthermore, the sheet P is fed to the transfer unit 240 including the photosensitive drum 221 and transfer roller 229. A transfer voltage is applied from a power source (not shown) to the transfer roller 229, and a toner image on the photosensitive drum 221 is transferred onto the sheet P. The sheet P on which the toner image is transferred is passed to the fixing device 10, and is heated and compressed. Thus, the toner image is fixed on the sheet P. After that, the sheet P is conveyed while being clamped by a discharge roller 230 and a counter roller 241, and is discharged onto a discharge tray.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-264735, filed Dec. 3, 2012 which is hereby incorporated by reference herein in its entirety.

What is claimed is:

1. A fixing device comprising:

a rotatable heating element which comprises a heat generation layer and a receiving coil required to generate a current to be supplied to the heat generation layer by electromagnetic induction, the heat generation layer being electrically connected to the receiving coil and generating heat by passage of the current;

a transmitting coil configured to generate a magnetic field required for the receiving coil to generate the current by electromagnetic induction; and a core member around which the transmitting coil is wound, wherein the receiving coil is mounted to an end portion of the rotatable heating element, and the transmitting coil and the receiving coil are arranged in a space formed inside the core member.

2. The device according to claim 1, wherein an outer diameter of the transmitting coil is smaller than an inner diameter of the receiving coil, and the transmitting coil is arranged on an inner circumference side of the receiving coil, and wherein an end portion of the rotatable heating element is inserted into the inner space of the core member, and the transmitting coil is wound around an inner circumferential surface of an outer circumferential surface and the circumferential surface which define the space.

3. The device according to claim 2, wherein the space has a cylindrical shape.

4. The device according to claim 1, wherein the heat generation layer is formed on a portion, which is not inserted into the space, of the rotatable heating element.

5. The device according to claim 1, further comprising a conductive member which connects the heat generation layer and the receiving coil, wherein an area of a region, which is inserted in the space, of the conductive member is smaller than an area of a region, which is not inserted in the space, of the conductive member.

6. The device according to claim 1, wherein a shape of the core member is a columnar shape, the core member has a circular first end face and a second end face, a ring-shaped communicating portion is formed in the second end face, the end portion of the rotatable heating element is inserted into the space via the ring-shaped communicating portion, a first through hole, which communicates with the space, is formed in the first end face, and a cable from a power source is connected to one end of the transmitting coil via the first through hole.

7. The device according to claim 6, wherein a second through hole, which communicates with the space, is formed in the second end face of the core member, and a cable from the power source is connected to the other end of the transmitting coil via the second through hole.

8. The device according to claim 6, wherein a cable from the power source is connected to the other end of the transmitting coil via the first through hole formed in the first end face of the core member.

9. The device according to claim 6, further comprising:

a pressure element which is in contact with a portion of an outer circumferential surface of the rotatable heating element as a flexible element to compress the portion of the outer circumferential surface of the rotatable heating element, and forms a nip portion between the pressure element and the rotatable heating element; and a guide member which is in contact with an inner circumferential surface of the rotatable heating element to restrict a rotation locus of the outer circumferential surface of the rotatable heating element, wherein a portion of a sectional shape of the rotatable heating element in a direction perpendicular to a rotation axis of the rotatable heating element is circular, and a remaining portion of the sectional shape is flattened by the guide member.

10. The device according to claim 9, further comprising a first holding member which holds an inner circumferential surface of one end portion of the rotatable heating element, wherein a circumferential surface of the ring-shaped communicating portion holds an inner circumferential surface of the other end portion of the rotatable heating element, and wherein the rotatable heating element is rotated while an inner circumferential surface thereof is in sliding contact with the first holding member and the circumferential surface of the ring-shaped communicating portion.

11. The device according to claim 9, wherein a shape of the ring-shaped communicating portion and the sectional shape in the direction perpendicular to the rotation axis direction of the rotatable heating element are circular.

12. The device according to claim 11, further comprising a holding member which is arranged between the ring-shaped communicating portion and the guide member in the rotation axis direction of the rotatable heating element, and holds a portion of the inner circumferential surface of the rotatable heating element, wherein the rotatable heating element is rotated while the inner circumferential surface thereof is in sliding contact with the holding member, and a sectional shape of the holding member in the direction perpendicular to the rotation axis direction of the rotatable heating element is circular.

13. The device according to claim 9, wherein a sectional shape of a portion of the ring-shaped communicating portion in the direction perpendicular to the rotation axis direction of the rotatable heating element is circular, and a sectional shape of a remaining portion is flattened.

14. The device according to claim 13, wherein the guide member is arranged so that a sectional shape of the ring-shaped communicating portion in the direction perpendicular to the rotation axis direction of the rotatable heating element correlates with the sectional shape of the rotatable heating element in the direction perpendicular to the rotation axis direction of the rotatable heating element.

15. The device according to claim 6, wherein a width of the ring-shaped communicating portion in a direction perpendicular to a rotation axis direction of the rotatable heating element is smaller than a width of an end portion of the rotatable heating element in the direction perpendicular to the rotation axis direction of the rotatable heating element.

16. The device according to claim 1, wherein a winding center of the transmitting coil matches a winding center of the receiving coil.

17. The device according to claim 1, wherein the transmitting coil and the receiving coil are concentrically formed.

18. The device according to claim 1, wherein the core member comprises:

a bowl-shaped outer member which is obtained by hollowing out a portion of a column in an axial direction; and an inner member which is attached while being inserted into an inner circumferential surface side of the outer member and forms the space between the inner member and the inner circumferential surface of the outer member, and around which the transmitting coil is wound.

19. An image forming apparatus comprising:

an image forming unit configured to form a toner image;

a transfer unit configured to transfer the toner image onto a sheet; and a fixing unit configured to fix the toner image on the sheet, wherein the fixing unit comprises:

a rotatable heating element which comprises a heat generation layer and a receiving coil required to generate a current to be supplied to the heat generation layer by electromagnetic induction, the heat generation layer being electrically connected to the receiving coil and generating heat by passage of the current;

a transmitting coil configured to generate a magnetic field required for the receiving coil to generate the current by electromagnetic induction; and a core member around which the transmitting coil is wound, the receiving coil is mounted to an end portion of the rotatable heating element, and the transmitting coil and the receiving coil are arranged in a space formed inside the core member.

* * * * *